US008579500B2

(12) United States Patent
Penula

(10) Patent No.: US 8,579,500 B2
(45) Date of Patent: Nov. 12, 2013

(54) TIMEPIECE (CLOCKWORK PART)

(76) Inventor: Joseph Penula, Chicago, IL (US)

( * ) Notice: Subject to any disclaimer, the term of this patent is extended or adjusted under 35 U.S.C. 154(b) by 850 days.

(21) Appl. No.: 12/311,763

(22) PCT Filed: Oct. 12, 2007

(86) PCT No.: PCT/IB2007/054161

§ 371 (c)(1),
(2), (4) Date: Nov. 20, 2009

(87) PCT Pub. No.: WO2008/044220

PCT Pub. Date: Apr. 17, 2008

(65) Prior Publication Data

US 2010/0135128 A1 Jun. 3, 2010

(30) Foreign Application Priority Data

Oct. 13, 2006 (CH) ..... 1634/06

(51) Int. Cl.

*G04B 45/00* (2006.01)
*G04B 37/00* (2006.01)
*G04B 47/04* (2006.01)

(52) U.S. Cl.

CPC ..... *G04B 45/0069* (2013.01); *G04B 37/005* (2013.01)
USPC ..... 368/281; 368/283; 368/285

(58) Field of Classification Search

USPC ..... 368/88, 276, 278, 281–283, 285, 286, 368/294, 299, 300, 316, 317; D10/1, 16, D10/17, 21, 23, 30, 31, 38
See application file for complete search history.

(56) References Cited

U.S. PATENT DOCUMENTS

| | | | | | |
|---|---|---|---|---|---|
| 1,199,256 | A | * | 9/1916 | Farr | 368/286 |
| 1,789,602 | A | * | 1/1931 | Siptrott | 368/316 |
| 1,853,483 | A | * | 4/1932 | Winters | 248/115 |
| D136,341 | S | * | 9/1943 | Dupin | D11/86 |
| 2,565,822 | A | * | 8/1951 | McClelland | 368/286 |
| D173,142 | S | * | 10/1954 | Bruce | D10/23 |
| 3,191,901 | A | * | 6/1965 | Green | 248/116 |
| D214,748 | S | * | 7/1969 | Toffolon | D10/9 |
| 4,464,063 | A | * | 8/1984 | Gogniat | 368/276 |
| 4,525,077 | A | | 6/1985 | Ketner | |
| 4,627,739 | A | * | 12/1986 | Shingo et al. | 368/282 |
| 4,835,750 | A | * | 5/1989 | Quincey | 368/286 |
| 4,837,756 | A | * | 6/1989 | Hartman et al. | 368/286 |
| D312,980 | S | * | 12/1990 | Kawashima | D10/132 |

(Continued)

FOREIGN PATENT DOCUMENTS

| | | |
|---|---|---|
| CH | 683 738 A3 | 5/1994 |
| DE | 10305305 | 9/2004 |

(Continued)

*Primary Examiner* — Vit W Miska
(74) *Attorney, Agent, or Firm* — Krieg DeVault LLP; Clifford W. Browning

(57) ABSTRACT

The band attachment device (1) and the closed case (17) together form the housing of the wristwatch. The device (1) is a perforated construction, the central part (2) of which contains the closed case (17) and the side parts (3 and 4) of which provide the connection to each half of the band. The device (1) is made entirely of elongate elements of metal or plastic sections joined by welding or adhesive bonding and arranged in such a way as to form a rigid, lightweight lattice.

8 Claims, 8 Drawing Sheets

(56) References Cited

U.S. PATENT DOCUMENTS

Figure 1:
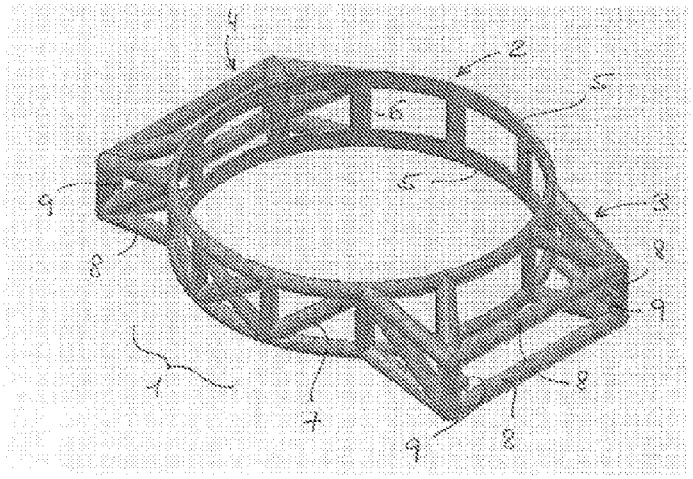

| | | | | | |
|---|---|---|---|---|---|
| 5,206,841 | A | * | 4/1993 | Boucheron | 368/276 |
| 5,442,602 | A | * | 8/1995 | Hirai et al. | 368/286 |
| 5,652,736 | A | * | 7/1997 | Lee | 368/278 |
| 5,848,030 | A | * | 12/1998 | Sullivan | 368/282 |
| 5,901,117 | A | * | 5/1999 | Delabre | 368/276 |
| D474,698 | S | * | 5/2003 | Parmigiani | D10/30 |

FOREIGN PATENT DOCUMENTS

| | | | |
|---|---|---|---|
| DE | 202006 013444 | | 12/2006 |
| GB | 106357 | * | 5/1917 |
| JP | 61 023989 A | | 2/1986 |

* cited by examiner

TIMEPIECE (CLOCKWORK PART)

This application claims the benefits under 35 U.S.C. 119 (a)-(d) or (b), or 365(b) of International Application No. PCT/IB2007/054161 filed Oct. 12, 2007, and Swiss Patent Application No. 01634/06 filed Oct. 13, 2006.

The present invention relates to clockwork parts and more particularly wrist watches in which the movement is positioned in a closed case and such case is attached to a support device and more particularly a wrist watch strap attachment device in the case of wrist watches, such device being distinct from the case but surrounding it.

In most currently known wrist watches, a unique member, called the case, can be found, which combines two functions consisting in keeping the movement confined in a generally tight closed space and connecting it to the strap, so that the watch can easily be worn on the wrist. However, many watches are also known wherein the two functions are separated so as to meet various needs such as the simplification of the manufacturing of the case, variation in the appearance of the attachment device, improvement of tightness properties etc. The application for German patent DE 10305305 A1 discloses a wrist watch of this type, but the latter only partially meets the mentioned needs.

The object of the present invention is to provide a clockwork part and more particularly a wrist watch of the above-mentioned type which better meets such needs than the already known clockwork part.

For this purpose, the present invention relates to a clockwork part including a closed case containing a movement and a support device which said case is attached to, characterised in that said support device is a rigid openwork structure having the shape of a lattice or a spiral which surrounds the sides of the case.

The support device may include a central part including two frames connected through bar segments positioned as distance pieces between the frames and the case can be engaged in the frames and attached to at least one of these.

The components of the openwork structure can be attached to each other by their ends, by gluing or mechanical welding.

The bar segments may be rectilinear or at least a part of said part segments may be curved.

According to one embodiment, the clockwork part is a wrist watch and the openwork structure is the device for the attachment of the strap and includes, further to the central part which surrounds it and attaches the case, two opposite side parts provided with means for connection to the strap, with the openwork structure being possibly a lattice structure.

At least one movement function manual control member can be removably mounted on one side of the case and the openwork structure can provide, in said annular central part, at least one opening enabling the positioning of said control member or members, with each of said side parts including, in the structure thereof, two receptacles with coaxial holes for the ends of a pushpin.

The side parts of the openwork structure can be composed of bar segments similar to those of the central part.

According to one embodiment, the openwork structure has the shape of a coil spring.

The openwork structure can be composed of hollow tubes.

Figure 2:
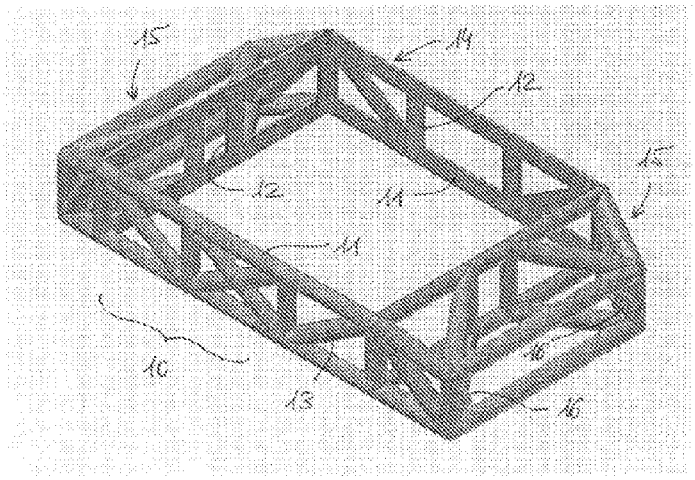
Figure 3:
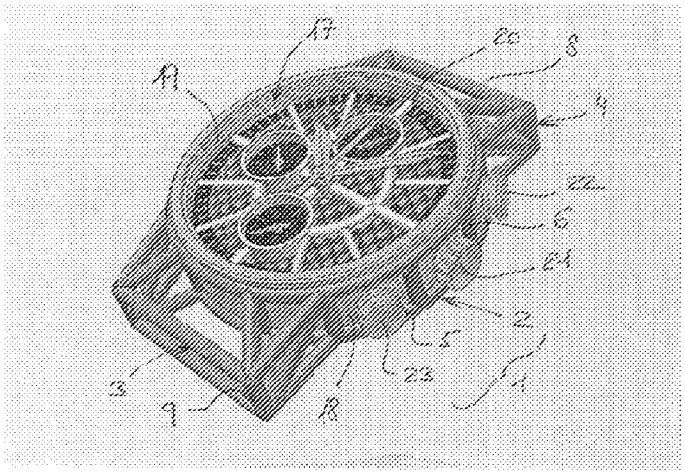
Figure 5:
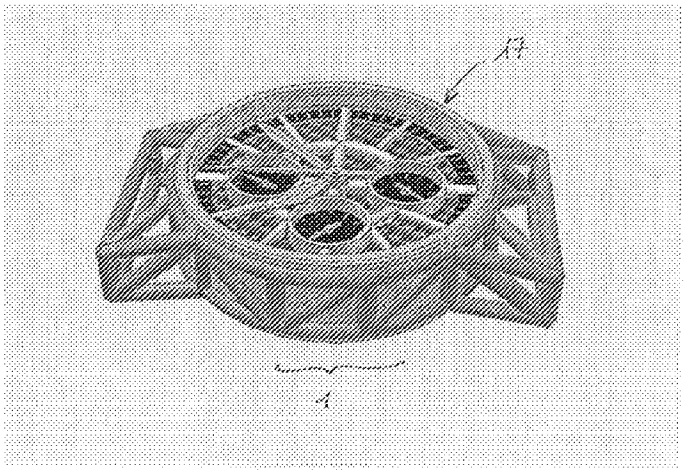
Figure 4:
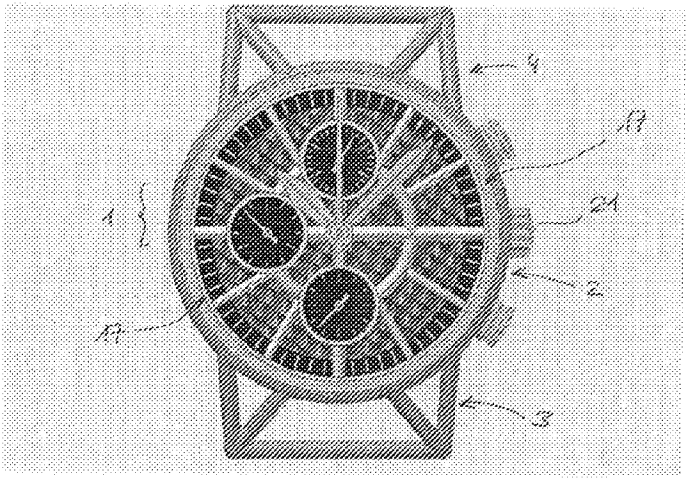

Hereinunder are disclosed, as examples, various embodiments of wrist watches according to the invention and a few alternative solutions, while referring to the appended drawings among which:

FIGS. 1 and 2 are perspective views of the device for the connection to the strap respectively in the first and the second exemplary embodiments, FIGS. 3, 4 and 5 are views, also in perspective, of the first embodiment of the watch without any strap.

Figure 6:
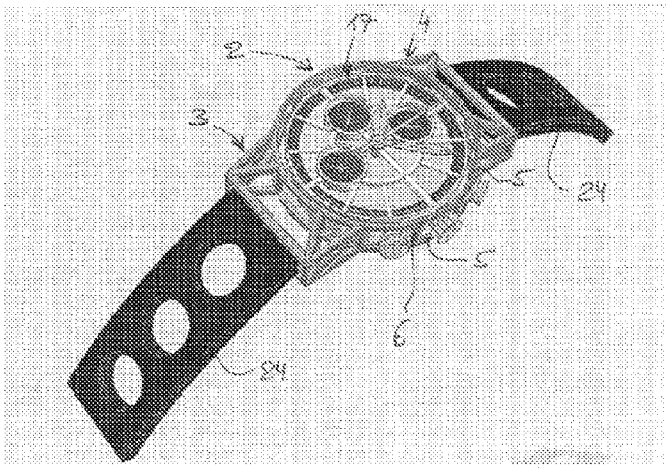
Figure 7:
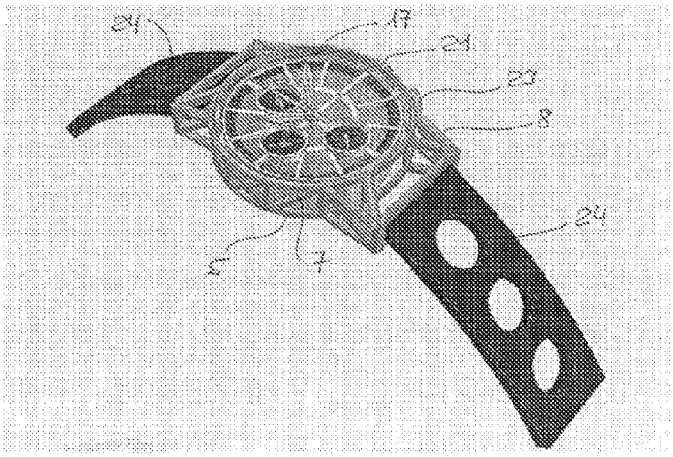
Figure 8:
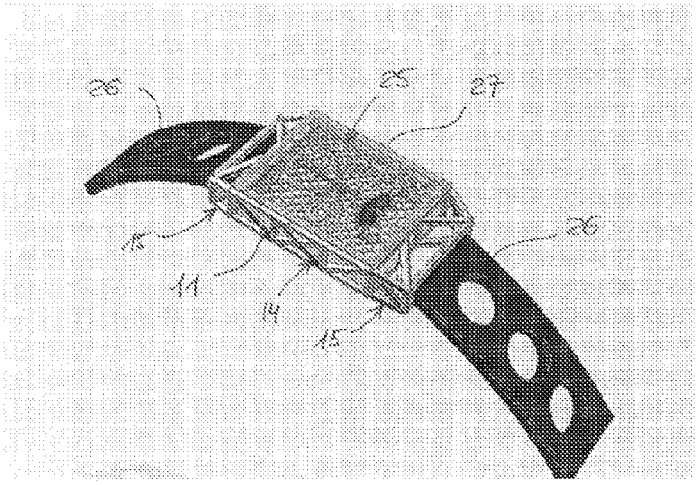
Figure 9:
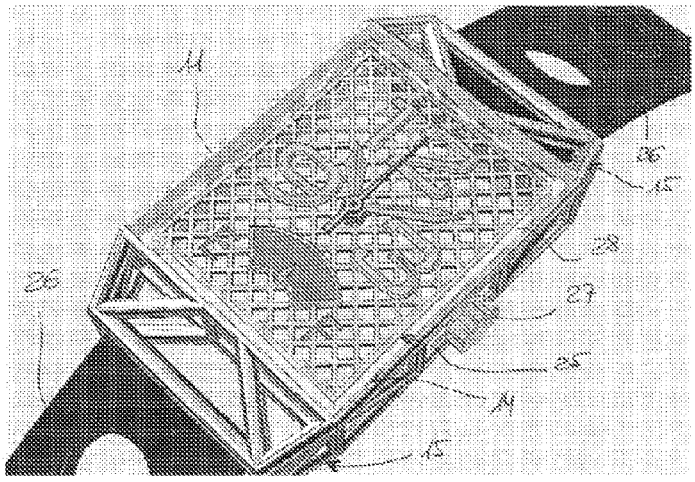
Figure 10:
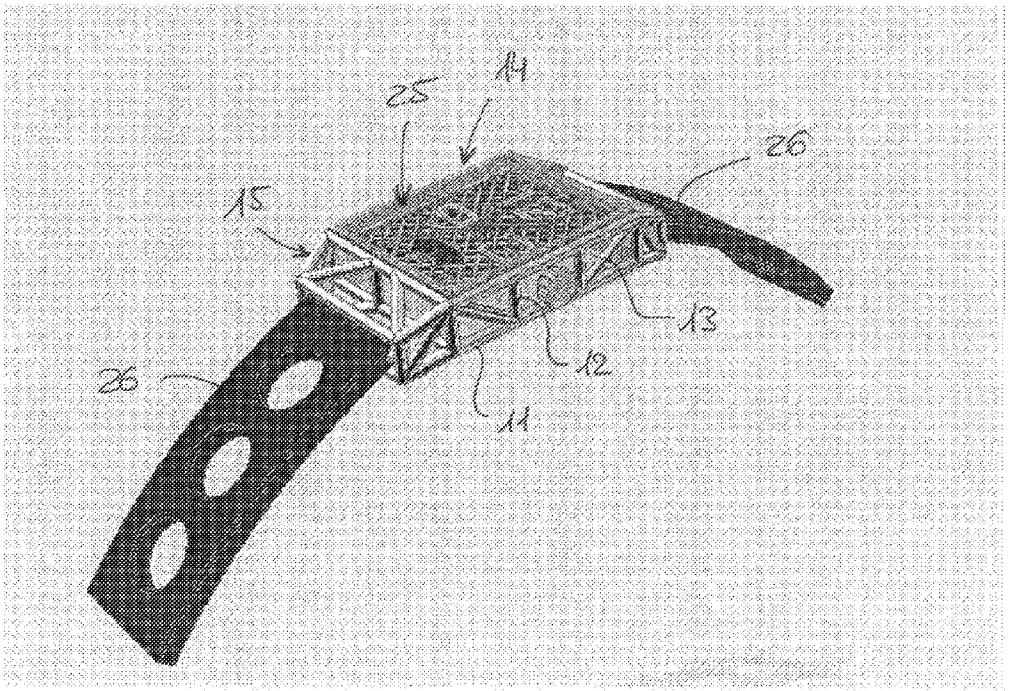
Figure 11:
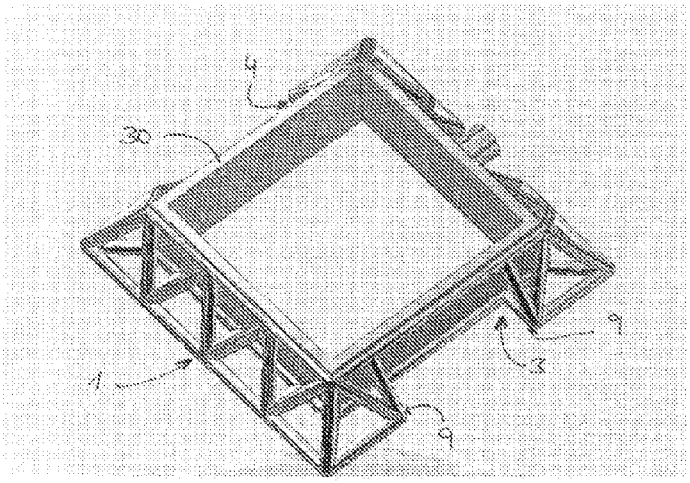
Figure 12:
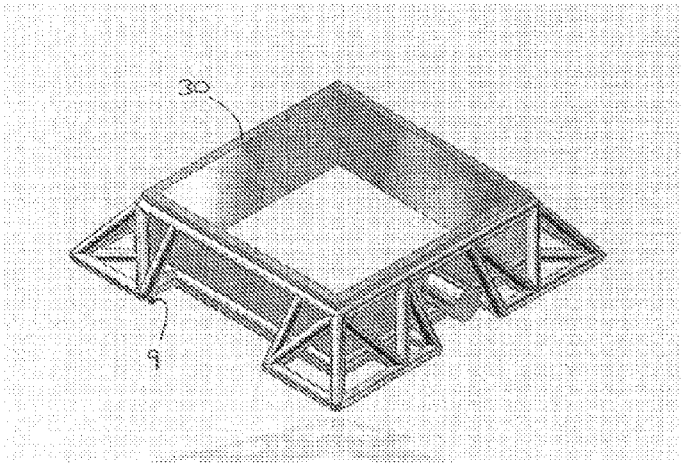
Figure 13:
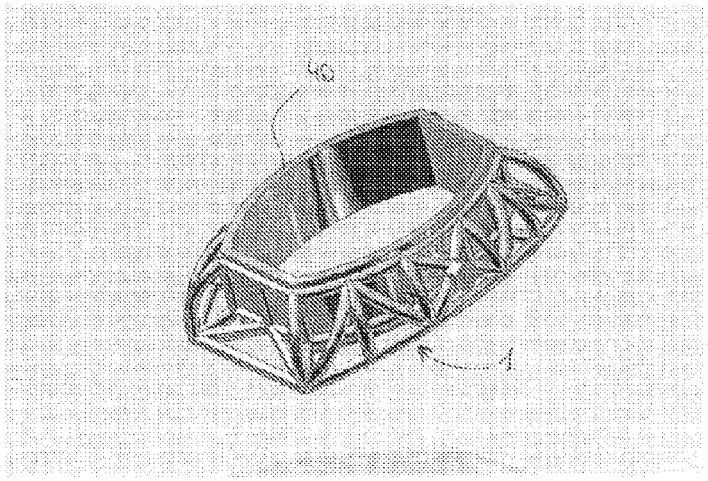
Figure 14:
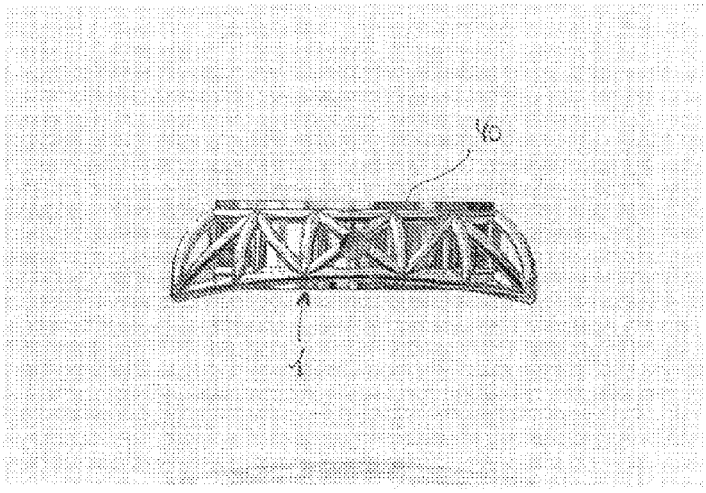
Figure 15:
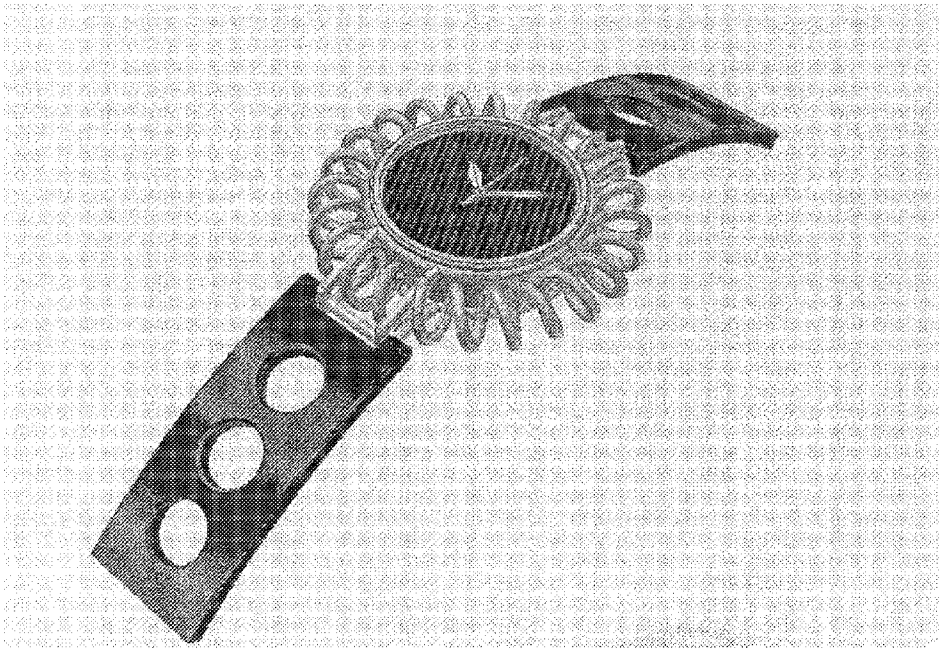

FIGS. 6 and 7 are perspective views of an alternative solution to the first embodiment with the strap, FIGS. 8, 9 and 10 are perspective views of the second embodiment of the watch with its strap, FIGS. 11 and 12 are perspective views of another square embodiment of the attachment device, FIGS. 13 and 14 are perspective views of an oval embodiment of the attachment device, and FIG. 15 is a perspective view of a watch including an attachment device according to another embodiment.

A noticeable particularity of the watch, of which several embodiments are shown in the drawing, is the structure of the attachment device for connection to the strap. FIGS. 1 and 2 show this structure in one application thereof to a round watch and to a rectangular watch, respectively. In both cases, the attachment device is totally composed of extended elements having a section and a profile which do not vary on their whole length, which allows a simple and rational pre-manufacturing. Such profile elements can be made of a plastic material or a metal, more particularly of gold, and include precious or semi-precious stones, or be based on a combination of said materials and elements. They may be covered with precious or semi-precious stones, for example diamonds. They can have circular, semi-circular or polygonal sections depending on the case. They may be composed of solid or hollow tubes. In the case of hollow tubes, these may contain a liquid, for example a liquid containing suspended particles, more particularly fluorescent particles, or any other composition intended to create an entertaining, decorative and/or an aesthetic effect.

In FIG. 1, the attachment structure 1 includes a circular central part 2 and two diametrally opposed side parts 3 and 4. The central part 2 is composed of two extended elements 5 which are curved in circles having the same diameter with semi-circle profiles connected through rectilinear and vertical bar segments 6, with some of such bars, such as the elements 7, being positioned obliquely so as to make the structure rigid. The side parts 3 and 4 are made of bar segments 8. These have various lengths and they are assembled so as to form kinds of frames with a slightly trapezoidal plane shape, connected to the circular frames 5. These are closed and the elements 6, 7 and 8 are connected thereto by their ends, which gives the connection device assembly a structure of a particularly rigid lattice even though the elements are very tapered in the length/section ratio. The elements composing the described structure are rigidly attached to each other by their ends, either by gluing or by welding, for example mechanical welding. According to an advantageous embodiment, the attachment structure 1 can be made by molding. It should be noted that in each side parts 3 and 4, two elements 8 positioned vertically on the outer side have bumps 9 facing each other and provided with an internal hole. Such coaxial holes are intended to receive the ends of a pushpin used for the connection to a strap.

In FIG. 2, an attachment device 10 corresponding to the second embodiment is provided for receiving a rectangular case. The structure thereof is similar to that of device 1, i.e. including, on the one hand, two rectangular frames 11 connected by bar rods 12 which are vertical or positioned as oblique distance pieces, as the elements 13, so as to form a central part 14 able to receive a closed case and, on the other hand, two side parts 15 in the shape of openwork frames provided with receptacles 16 with coaxial holes for the engagement of the ends of the pushpins. The frame elements 11, as well as the bars 12 and 13 of the central part 14 and of the side parts 15 are all rectilinear. Their profile has the shape of a semi-circle, except for some elements of the side parts which are circular. Such profiles could also have an oval or a polygonal shape.

The attachment device 1 in FIG. 1 is shown again in FIGS. 3, 4 and 5, but this time it is provided with a closed case 17 adjusted to the dimensions of the central part 2. The case 17 also includes a cylindrical side wall 18 which serves as the middle of the conventional cases, to which is fixed a crystal 19 which covers a dial 20 mounted on the movement accommodated in the case. In the case of FIGS. 3, 4 and 5, this is a chronograph movement the functions of which need not be described in detail. It should however be noted that the usual control members i.e. the time setting crown 21 and the push buttons and resetting buttons 22, 23 are made so that they can be mounted on the middle 18 after the engagement of the case 17 inside the part 2, between the frames 5. For this purpose, the vertical mounts 6 positioned on the right part, i.e. at three in the connection device, are sufficiently spaced apart to enable this operation. As can be seen in FIG. 5, on the left side i.e. at nine, the distance pieces of the attachment structure include oblique or even (FIG. 1) X shaped elements 7. The case 17 will be fixed in the central part 2 of the attachment device by any appropriate means in a permanent way or so that it can be removed. It will include a removable screwed or notched back giving access to the movement. All the usual techniques for manufacturing the movement, the indicating members and the case can be used without any problem here.

FIGS. 6 and 7 illustrate an alternative solution of the exemplary embodiment of the wrist watch of the first embodiment with its strap. In this alternative solution, the case of the watch is made of sapphire thus transparent. FIGS. 6 and 7 also show both ends 24 of the strap connected by usual pushpins to the side parts 3 and 4 in the holes 9.

FIGS. 8, 9 and 10 are views of the wrist watch according to the second embodiment with the attachment device 10 of FIG. 2, a closed case 25 having a rectangular shape being engaged in the central part 14 and both ends of the strap 26 being connected to the side parts 15. The movement accommodated in the case 25 is here a usual watch movement with only one control member, i.e. a time setting crown 27 which is also used as a winder in the case of a mechanical movement. Such crown will be positioned between two vertical bars 12 after the case is engaged in the attachment device.

FIGS. 11 and 12 are perspective views of another embodiment of the attachment device for a squared shape case. On these views, the case 30 is shown without any movement, any back, nor any dial. In this embodiment, the connection structure shows a triangular section forming pyramidal elements at each corner of the watch. In addition, the side parts 3 and 4 for connecting the strap are simplified and the dimension thereof is minimum.

Still another embodiment of the attachment structure is shown in FIGS. 13 and 14 for a case 40 having a curved side shape, with the attachment structure 1 being in this case made so as to give a barrel external shape.

As a whole, the disclosed wrist watch is characterised by its original appearance which gives it a very light aspect, even in the case of a chronograph watch with a robust construction. The openwork connection device which is totally made of section bar segments is not very costly which makes it possible to use precious metals. In addition, this construction is very rigid and robust, although it is light.

Other embodiments are also possible when developing the idea of a attachment device using wire shaped section elements according to the hereabove described figures to obtain an openwork structure. For example, a wire wound in a coil spring and closed in a circle as shown in FIG. 15 or in a rectangle could be the central part of the strap connection device. The persons skilled in the art can also imagine varied solutions for this device.

Although the examples described hereabove are all related to wrist watches, the invention also applies to any clockwork part including a movement positioned in a closed case, with the case being connected to a support device separate from the case but surrounding it such as mantle clocks, clocks, small clocks, table watches, or watches intended to be integrated in cars and any other road, sea or air vehicles.

The invention claimed is:

1. A wrist watch including a closed case containing a movement and a support device which said case is attached to, wherein said support device is a rigid openwork structure which surrounds the sides of the case, wherein said openwork structure is a lattice structure, wherein said openwork structure is a device for attaching a wrist strap and includes, in addition to a central part which surrounds and attaches the case, two opposite side parts provided with connection means to the strap and wherein said support device includes a central part including two frames connected by vertically oriented bar segments and obliquely oriented bar segments positioned as distance pieces between the frames and in that the case is engaged in the frames and attached to at least one of these.

2. A wrist watch according to claim 1, wherein the components of said openwork structure are attached to each other by their ends, by gluing or mechanical welding.

3. A wrist watch according to claim 1, wherein said bar segments are rectilinear.

4. A wrist watch according to claim 1, wherein at least a part of said bar segments is curved.

5. A wrist watch according to claim 1, wherein at least one movement function manual control member is removably mounted on one side of the case and in that said openwork structure provides, in said central part, at least one opening enabling the positioning of said control member or members.

6. A wrist watch according to claim 1, wherein each of said side parts includes, in the structure thereof, two receptacles with coaxial holes for the ends of a pushpin.

7. A wrist watch according to claim 1, wherein the side parts of the openwork structure are formed with bar segments similar to bar segments forming the central part.

8. A wrist watch according to claim 1, wherein the openwork structure is formed with hollow tubes.

* * * * *